United States Patent [19]

Paulsen et al.

[11] Patent Number: 4,574,824

[45] Date of Patent: Mar. 11, 1986

[54] AGITATOR FOR COIN HOPPER

[75] Inventors: Craig A. Paulsen; Raymond G. Bryan, both of Reno, Nev.

[73] Assignee: IGT, Reno, Nev.

[21] Appl. No.: 628,943

[22] Filed: Jul. 10, 1984

[51] Int. Cl.[4] ..... G07D 9/04

[52] U.S. Cl. ..... 133/4 R; 366/325

[58] Field of Search ..... 133/4 R, 4 A, 2, 3 H, 133/8 R; 222/242, 227, 406, 230, 228; 366/325, 326, 343; 221/203

[56] References Cited

U.S. PATENT DOCUMENTS

| | | | |
|---|---|---|---|
| 829,204 | 8/1906 | Hackburn et al. | 222/407 X |
| 3,111,305 | 11/1963 | Bates et al. | 366/325 |
| 3,942,544 | 3/1976 | Breitenstein et al. | 133/4 R |

*Primary Examiner*—Stanley H. Tollberg
*Attorney, Agent, or Firm*—Townsend and Townsend

[57] ABSTRACT

An improved agitator for a coin hopper having a rotatable pinwheel includes a hub mounted to the pinwheel and a plurality of elongated, longitudinally resilient blades projecting radially outward from the hub. The hub is preferably made of neoprene or other flexible material, and is mounted to the center of the plate so that the two rotate together. The blades are preferably made of spring steel or similar material and are not themselves attached to the pinwheel, but are embedded in the hub. The blades have hard, low friction surfaces, and longitudinally yield upon impact with the coins in the hopper and act to stir the coins and urge them into coin receiving slots on the pinwheel.

10 Claims, 3 Drawing Figures

AGITATOR FOR COIN HOPPER

BACKGROUND OF THE INVENTION

1. Field of the Invention

This invention relates generally to coin counting and dispensing mechanisms, and specifically to an improved agitator for the coin hopper of these machines.

2. Description of the Prior Art

Coin counting and dispensing machines are well known. For example, Breitenstein et al., U.S. Pat. No. 3,942,544 discloses a hopper payout device that can be used for various coin denominations. Such machines typically include an inclined hopper capable of holding a volume of coins against a rotatable plate or pinwheel. The peripheral portion of the pinwheel is sectioned to receive and isolate single coins, and these coins are then carried by the rotating pinwheel to a counter mechanism and discharge chute.

Due to their inherent shape, coins frequently build up within the hopper to interlock, wedge or otherwise block the entry of single coins into the coin receiving sections, thereby reducing the efficiency of the overall system. Payout efficiency is a measure of the percentage of receiving slots on the pinwheel that are filled with a coin, and thus carried to the discharge chute for dispensing. It is desirable to maximize this payout efficiency because while a coin hopper is dispensing coins, the machine is usually inoperative, thereby reducing its effective useable time. Thus, the faster a given payout can be achieved, the quicker the machine will be returned to service.

The Breitenstein et al. device includes a three-legged rigid agitator positioned centrally on the pinwheel. This agitator serves to stir the collection of coins within the hopper, and urges the coins into alignment with the coin receiving sections at the peripheral portion of the pinwheel. The dimensions of the agitator are determined by a formula dependent upon the diameter and thickness of the coins to be dispensed. Thus, the agitator is designed to be replaceable to accommodate differing coin sizes. It has been found that the Breitenstein et al. agitator achieves a payout efficiency of only on the order of 26%.

An improvement to the Breitenstein et al. agitator is suggested in Nicolaus, U.S. Pat. No. 4,148,331. The Nicolaus device provides an elastomeric agitator with a plurality of fingers, characterized by flexibility at all points and surfaces exposed to impact by and with the coins. The Nicolaus specification states that payout efficiency with that agitator is increased to about 79%.

SUMMARY OF THE INVENTION

The present invention provides an improved agitator for use with a coin hopper having a rotatable pinwheel with circumferential coin receiving sections, a central hub of relatively small diameter mounted to the pinwheel and a plurality of elongated, longitudinally resilient blades or vanes projecting radially outward from the hub. The hub is preferably made of neoprene or other flexible, elastomeric material, and is fixedly mounted to the center of the pinwheel so that the two rotate together. The blades are preferably made of spring steel or a similar material, and may be zinc plated for increased durability. The blades are of a length sufficiently less than the radius of the pinwheel to avoid interference with the rest of the hopper mechanism, and, in a preferred embodiment, are of a height about equal to or slightly larger than the combined thickness of two coins. The blades have their innermost ends embedded in the hub, and thus move with it. While the blades have hard, low friction surfaces, they are resilient upon impact with the coins in the hopper, and act to stir the coins and urge them into position in the coin receiving sections of the pinwheel periphery. This arrangement of centrally attached, longitudinally resilient blades provides improved agitating characteristics to the coin hopper, and results in an improved payout efficiency.

Although applicant is uncertain what causes the increased efficiency, it is believed that a number of factors contribute to it. First, because the blades are longitudinally resilient, and are not themselves attached to the rotating pinwheel, they are free to bend back upon impact with the coins and impart a catapult-like thrust to the coins that appears to improve the positioning of the coins in the receiving slots. In addition, it is felt that this longitudinal resiliency enables a preferred and variable angle of attack with respect to the coins, an improvement over fixed, rigid blades. Furthermore, because the surfaces of the blades are hard and smooth, it is felt that they more efficiently transfer kinetic energy to the coins, reduce friction between the coins and the blades (which could lead to sticking) and, therefore facilitate the movement of the coins in a radially outward direction towards the pinwheel.

DETAILED DESCRIPTION OF A PREFERRED EMBODIMENT

Figure 1:
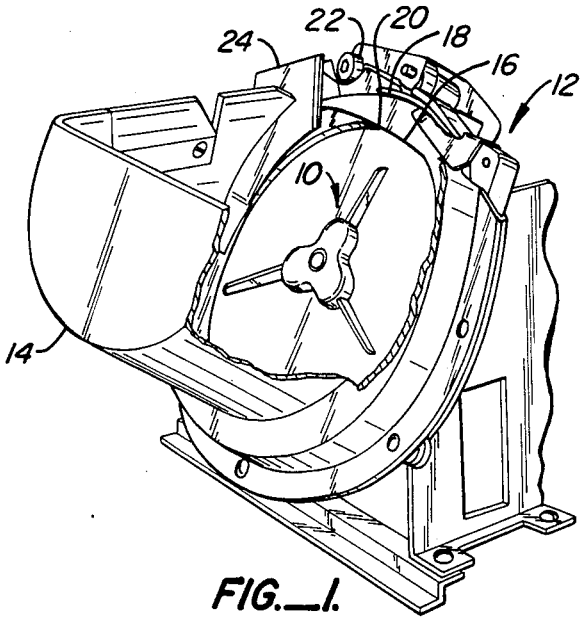
FIG. 1 is a perspective view of an agitator as installed on a rotatable plate or pinwheel of a typical coin hopper (shown in phantom)

FIG. 1 is a perspective view of an agitator 10 installed on a coin counting and dispensing machine 12. The machine 12 includes an inclined coin hopper 14, which holds a volume of coins against a rotatable plate or pinwheel 16. The peripheral portion of the pinwheel 16 includes a plurality of coin receiving sections 18, which are adapted to accommodate a single coin of the selected denomination. The thus-isolated coins are carried by the rotating pinwheel towards a knife 20, which removes the coin from the section and delivers the coin to a counting mechanism 22 and a discharge chute 24 for dispensing. The purpose of the agitator 10, then, is to stir up the coins held in the hopper 14 and urge them toward and into alignment with the coin receiving sections 18 of the rotating pinwheel 16.

Figure 2:
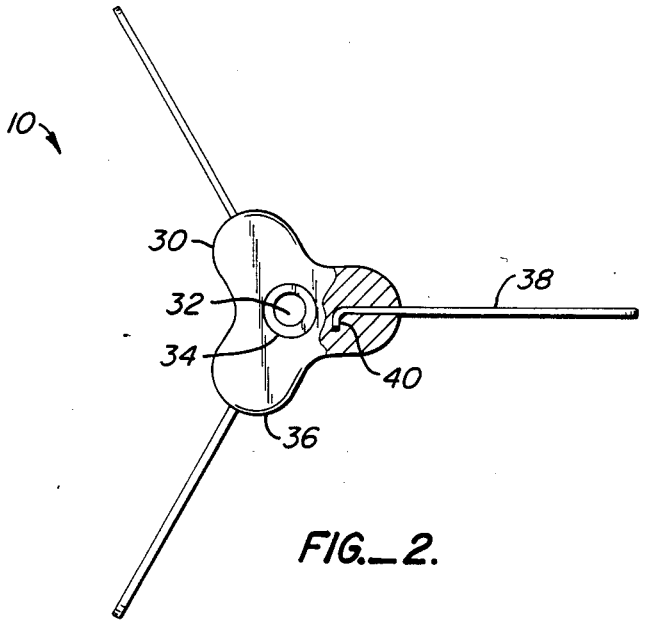
FIG. 2 is a partially cutaway plan view of a three blade version of the agitator for coin hopper of this invention.

FIG. 2 is a partially cutaway plan view of a three blade version of the agitator 10 of this invention. The agitator 10 includes a hub 30 which has a flexible surface and is composed of rubber, neoprene or other elastomeric material. In use the hub 30 rotates to agitate the coins in the hopper, preferably by securing it with a threaded bolt (not shown) or the like to the rotatable pinwheel of the coin hopper at its central axis 32. A bushing 34 is provided to facilitate the centering and mounting of the hub. The hub 30 preferably defines a plurality of lobes 36, which extend radially outward from the hub center.

Mounted on each of the lobes is an elongate, longitudinally resilient blade or vane 38, which projects radially outward from the lobes. The blades are secured to the lobes, and hence the hub, by forming turned ends 40 thereon and molding or vulcanizing the ends to the hub to form a unitary agitator. The blades 38 are preferably constructed from zinc plated spring steel or similar material, giving a hard, low friction surface. They are typically of a length slightly less than the radius of the rotating plate (e.g. 1.75 inches), and of a height to accommodate the combined thickness of two coins (e.g. 0.25 inches). A blade height much greater than this reduces the efficiency of the agitator. The blades are thin enough and are mounted on the hub in such a manner that they are longitudinally resilient and yield upon contact with the coins in the hopper.

There can, of course, be any number of lobes and accompanying blades to the agitator. However, it has been found that the three- or four-blade versions are the most cost-effective. In the presently preferred embodiment, the lobes 36 of the hub are relatively short in the radial direction and extend approximately one-third of the distance from the center of the hub to the radial ends of the blades. The relatively small size of this central hub allows more space for coins to sit in between the blades of the agitator and enhances the flexibility of the blades.

Figure 3:
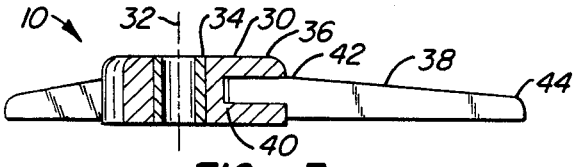
FIG. 3 is a partially cutaway side view of the agitator of FIG. 2.

FIG. 3 is a partially cutaway side view of the agitator shown in FIG. 2. Here, the blade 38 is shown in its preferred shape, slightly tapered from its point of contact 42 with the hub to its remote end 44 (e.g., from a maximum height of 0.25 inches to a minimum height of 0.12 inches at its outer end). This taper enhances the payout efficiency of the agitator.

Experimental tests have confirmed the improved efficiency of this design over the prior art agitators. For example, a test comparing the time required for various agitators to deliver 400 coins to the discharge chute was conducted using a 12 slot pinwheel rotating at a constant 24 revolutions per minute. Assuming 100% agitation efficiency (that is, every receiving slot on the rotating plate is filled with a coin) delivery of the 400 coins would take 83.33 seconds [(400 coins)×(one revolution per 12 coins)×(one minute per 24 revolutions)×(60 seconds per minute)=83.33 seconds]. The results of this test are tabulated in Table I.

TABLE I

400 COIN TEST: TIME (IN SECONDS) REQUIRED FOR DISCHARGE

| run # | prior art agitator* | 3 blade agitator w/o taper | 3 blade agitator w/taper | 4 blade agitator w/taper |
|---|---|---|---|---|
| 1 | 102 | 93 | 103 | 95 |
| 2 | 100 | 97 | 95 | 97 |
| 3 | 104 | 98 | 93 | 92 |
| 4 | 100 | 93 | 90 | 92 |
| 5 | 103 | 97 | 94 | 91 |
| 6 | 104 | 93 | 95 | 99 |
| 7 | 108 | 94 | 94 | 92 |
| 8 | 107 | 101 | 93 | 97 |
| 9 | 98 | 98 | 94 | 92 |
| 10 | 98 | 92 | 93 | 94 |
| mean | 102.4 | 95.6 | 94.4 | 94.1 |
| standard deviation | 3.5 | 3.0 | 3.3 | 2.8 |
| efficiency | 81.4% | 87.2% | 88.3% | 88.6% |

*Constructed in accordance with the Nicolaus Pakut

As the test results indicate, not only is the inventive design more efficient at filling the positions on the rotating pinwheel (88.6% versus 81.4%), but the inventive design is also more consistent at doing so (standard deviation of 2.8–3.3, as compared to 3.5 for the prior art device). Thus machines, such as gaming devices, having a coin hopper fitted with an agitator constructed in accordance with the invention take less time to effect the pay out of coins, have, therefore, longer playing times and result in enhanced profits for the operator.

While this invention has been described in connection with preferred embodiments thereof, it is obvious that modifications and changes therein may be made by those skilled in the art to which it pertains without departing from the spirit and scope of the invention. For example, rather than being perfectly straight, the exposed blades could be turned at their remote end, or otherwise configured to accomplish the desired agitation. Accordingly, the scope of this invention is to be limited only by the appended claims.

What is claimed as the invention is:

1. A coin hopper comprising a rotatable pinwheel adapted to position coins along a peripheral portion of the wheel;

a hub constructed of a material having a flexible surface and mounted to the pinwheel, and a plurality of elongated, longitudinally resilient blades extending from the hub towards the peripheral portion and having a relatively hard, low friction surface, the blades being oriented transversely to the pinwheel and having a height greater than the thickness of the coins, whereby the blades agitate the coins in the hopper during rotation of the pinwheel to facilitate the positioning of the coins on the peripheral portion of the pinwheel.

2. A coin hopper according to claim 1 wherein the blades are constructed of a metal.

3. A coin hopper comprising a rotatable pinwheel having a peripheral portion for the positioning of coins therealong, a hub mounted concentrically with respect to the pinwheel and constructed of a flexible material, a plurality of blades having first ends embedded in the hub and second ends proximate the peripheral portion of the pinwheel, the hub extending in a radial direction approximately one-third of the distance from the center of the hub to said second ends, the blades being constructed of metal and being longitudinally resilient, having a height greater than the height of an individual coin in the hopper and being oriented substantially perpendicular to the pinwheel and means for imparting rotation to the hub when the pinwheel rotates, whereby coins in the hopper are agitated by the blades, urged towards the peripheral portion of the pinwheel and oriented generally parallel to the pinwheel to increase the number of coins positioned along the peripheral portion as the pinwheel rotates.

4. An agitator for use with a coin hopper having a rotatable pinwheel adapted to position coins in coin receiving slots on its peripheral portion comprising:

a hub portion of relatively small diameter mounted to the center of said pinwheel, said hub having a flexible surface; and a plurality of longitudinally resilient blades attached to and extending radially outward from said hub portion so that they do not themselves contact said pinwheel, said blades having a hard, low friction surface.

5. The agitator of claim 4 wherein said hub includes a plurality of radially extending lobes.

6. The agitator of claim 5 wherein said blades are attached to said lobes.

7. The agitator of claim 6 wherein said lobes extend approximately one-third of the distance from said center to the radial ends of said blades.

8. The agitator of claim 6 having three lobes and three blades.

9. The agitator of claim 4 wherein said blades are tapered from a maximum height at their point of attachment to said hub, to a minimum height at their radialmost end.

10. The agitator of claim 9 wherein said minimum height is approximately equal to the thickness of two coins.

* * * * *